United States Patent [19]

Matsuura et al.

[11] 4,205,492

[45] Jun. 3, 1980

[54] DIGITALLY CONTROLLED GRINDING MACHINE WITH REST APPARATUS

[75] Inventors: Akihiro Matsuura, Kariya; Minoru Enomoto, Ohbu, both of Japan

[73] Assignee: Toyoda-Koki Kabushiki-Kaisha, Kariya, Japan

[21] Appl. No.: 946,022

[22] Filed: Sep. 26, 1978

[30] Foreign Application Priority Data

Oct. 21, 1977 [JP] Japan ..... 52-127033

[51] Int. Cl.[2] ..... B24B 49/02; B24B 41/06

[52] U.S. Cl. ..... 51/165.77; 51/238 S

[58] Field of Search ..... 51/238 S, 238 R, 165.77, 51/165.88

[56] References Cited

U.S. PATENT DOCUMENTS

| | | | |
|---|---|---|---|
| 3,967,414 | 7/1976 | Tamesui | 51/238 S |
| 3,977,129 | 8/1976 | Bottomley | 51/238 S |

*Primary Examiner*—Harold D. Whitehead

*Attorney, Agent, or Firm*—Oblon, Fisher, Spivak, McClelland & Maier

[57] ABSTRACT

A digitally controlled grinding machine provided with a rest apparatus which is opposed to a wheel head, carrying a grinding wheel, for supporting against grinding resistance a workpiece rotatable on a support device, and with a measuring device, which outputs first and second size signals to a digital feed controller respectively when the workpiece is ground to first and second predetermined sizes. The feed controller controls a first servomotor to advance a pair of shoes of the rest apparatus until the first size signal is output and also controls a second servomotor to advance the wheel head until the second size signal is output. The controller, when receiving the second size signal, controls the first servomotor to retract each of the shoes by a predetermined retraction amount, being set in a digital switch, from an advanced end position which is adjusted in dependence upon the first size signal and in a successive grinding cycle, controls the first servomotor to start the advance feed of each of the shoes from a retracted end position which is spaced by the predetermined retraction amount from the advanced end position, so that compensation is made for wear of the shoes.

6 Claims, 6 Drawing Figures

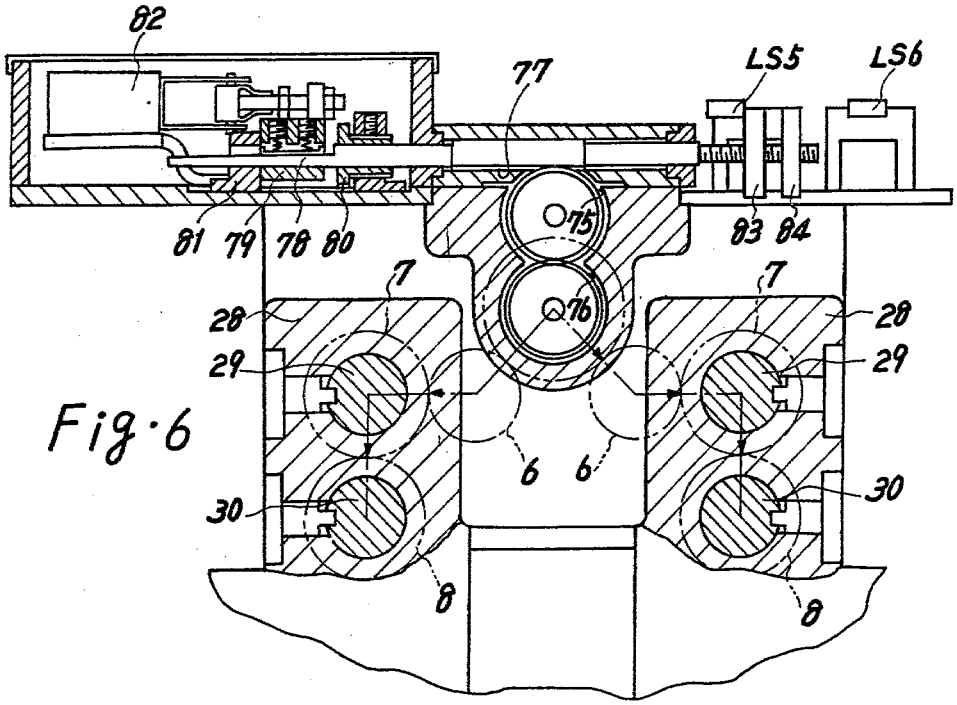
Fig. 6
Fig. 5
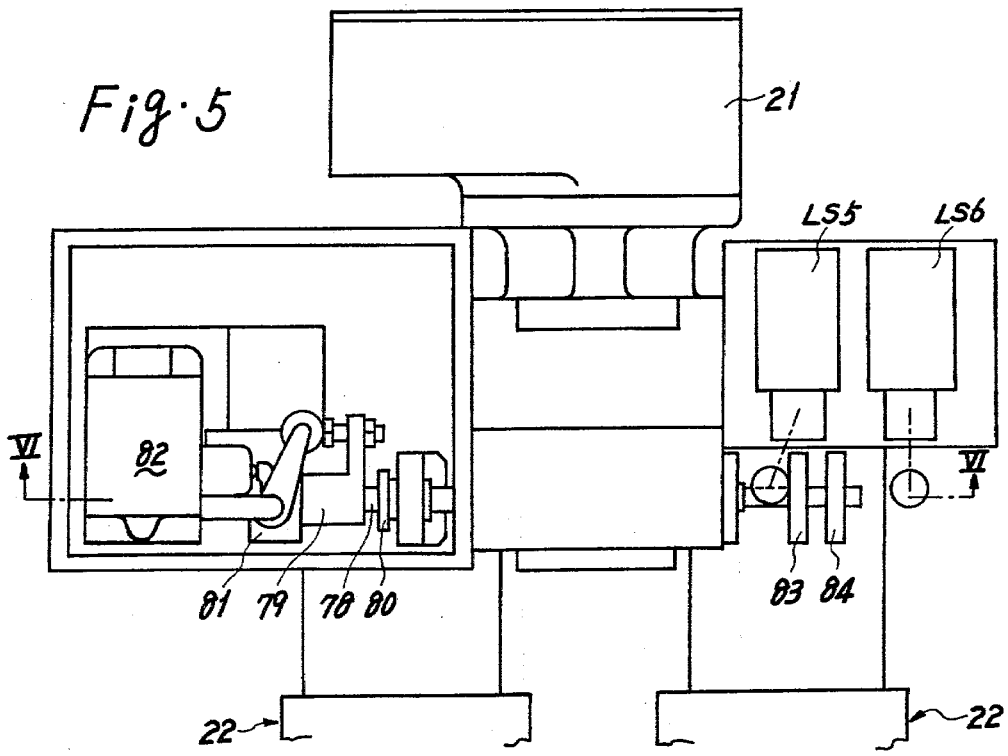

DIGITALLY CONTROLLED GRINDING MACHINE WITH REST APPARATUS

BACKGROUND OF THE INVENTION

1. Field of the Invention

The present invention relates to a digitally controlled grinding machine with a rest apparatus for supporting a workpiece, rotatably carried on a workpiece support device, against grinding resistance.

2. Description of the Prior Art

Heretofore, there have been used rest apparatus which are unable to perform an automatic compensation for wear of a pair of rest shoes, and it has been required that an operator frequently readjust the positions of the rest shoes.

In general, the press of a pair of shoes of a rest apparatus against a circumferential surface of a workpiece must be carried out after the circumferential surface is roughly ground to have its roundness and surface roughness improved up to a certain grade, and each of the shoes must be advanced to the position where they are able to completely remove from the workpiece a flexing caused by grinding resistance.

To this end, in a certain kind of the prior rest apparatus, as disclosed in U.S. Pat. No. 3,967,414 to T. Tamesui et al, a pair of rest shoes are advanced by a predetermined amount in a first step after a rough grinding feed of a wheel head is discontinued based upon a first size signal from a workpiece measuring device or a signal issued when the rough grinding feed attains a feed amount being preset in a setting device. Following this, the advance feed of the wheel head is restarted, and after the advance feed of the wheel head is discontinued based upon a second size signal from the measuring device, a second step is initiated to advance the shoes. This second step is then terminated when a third size signal is generated from the measuring device.

Since the feed of the shoes in the second step is controlled based upon the third size signal obtained as a result of measuring the workpiece in process, it had been understood that wear of the shoes, even if any, does not have any effect on grinding accuracy of the workpiece. However, there was observed a phenomenon that the geometric accuracy such as roundness of workpieces finished under the use of the prior rest apparatus is deteriorated in proportion to increase of the workpieces in number, and therefore, it is deduced that the deterioration of the geometric accuracy is measurably caused by wear of the shoes.

Directing attention now to the feed of the shoes in the first step, if some wear is effected on the shoes, the pressing surfaces of the shoes are retracted by the wear amount, and the shoes, when at their advanced end positions are advancing by a predetermined amount, are unable to press the workpiece back onto an ideal rotational axis thereof, whereby a flexing caused by grinding resistance remains in the workpiece as indicated at P2 in FIG. 3. It is therefore deduced that the retention of the flexing results in deterioration of the roundness of the workpiece at a stage that passes from a rough grinding step to a fine grinding step, that, even when the workpiece is ground to a finished size, the deteriorated roundness is left uncured, thus causing the workpiece to take the form of an ellipse, and that the tendency to take the form of an ellipse is developed in proportion to the growth of wear of the shoes.

SUMMARY OF THE INVENTION

Accordingly, it is a primary object of the present invention to provide an improved grinding machine having a rest apparatus which is capable of performing automatic compensation for wear of at least one rest shoe.

Another object of the present invention is to provide an improved grinding machine wherein any flexing of a workpiece caused by grinding resistance is completely removed by a rest apparatus before a fine grinding step so that the same is then carried out with the workpiece rotating about an ideal rotational axis thereof.

A further object of the present invention is to provide an improved grinding machine wherein, by retracting at least one rest shoe a predetermined amount from an advanced end position which is adjusted in dependence upon a size signal from a measuring device, an advance start position of the rest shoe in each grinding cycle is automatically adjusted relative to that in a previous grinding cycle by an amount through which the rest shoe has worn off in the previous grinding cycle.

According to the present invention, there is provided a grinding machine comprising a base, a workpiece support device mounted on the base for rotatably carrying a workpiece, a wheel head slidable toward and away from the workpiece and adapted to rotatably carry a grinding wheel, and a rest frame, on which at least one rest shoe is carried for supporting the workpiece against grinding resistance. The grinding machine further comprises a measuring device, which measures the workpiece in process for generating first and second size signals respectively when the workpiece is ground to first and second predetermined sizes. A wheel feed motor and a shoe feed motor are provided to respectively move the wheel head and the rest shoe toward and away from the workpiece.

The grinding machine is characterized by the provision of a feed controller, which controls the shoe feed motor to advance the rest shoe until the first size signal is generated and also controls the wheel feed motor to advance the wheel head until the second size signal is generated. The controller, when receiving the second size signal, controls the shoe feed motor to retract the rest shoe a predetermined amount from an advanced end position which is adjusted in dependence upon the first size signal.

Since the advance feed of the rest shoe in each grinding cycle is started from a retracted end position to which the rest shoe is retracted by the predetermined amount from the advanced end position in a previous grinding cycle, there is automatically achieved a compensation for wear of the rest shoe, and the feed amount of the rest shoe toward the workpiece in every grinding cycle is almost constant irrespective of wear of the shoe. Accordingly, once the advanced end position of the shoe is precisely adjusted, roundnesses of workpieces finished by the grinding machine can be maintained highly stabilized.

In another aspect of the present invention, the rest shoe is advanced toward the workpiece a predetermined amount from the retracted end position in a first shoe feed step after a rough grinding of the workpiece and, in a second shoe feed step, is readvanced until the first size signal is generated from the measuring device. Since the retracted end position is compensated for any wear which has been effected on the rest shoe in a previous grinding cycle, a pressing surface of the rest shoe reaches a predetermined position at the end of the first shoe feed step in each successive grinding cycle. Accordingly, any flexing of the workpiece in process can be completely removed at the final stage of the rough grinding, that is when the rest shoe reaches an end position of feed in the first shoe feed step, so that the roundness of the workpiece at the final stage of the rough grinding is improved, thus leading to a greater improvement of the roundness of the workpiece at the end of a fine grinding.

BRIEF DESCRIPTION OF THE DRAWINGS

Various other objects, features and attendant advantages of the present invention will readily be appreciated as the same becomes better understood from the following detailed description of preferred embodiments when considered in connection with the accompanying drawings, wherein like reference numerals designate like or corresponding parts throughout the several views, and in which:

FIG. 5 is a fragmental plan view of a rest shaft feed mechanism in a further embodiment; and FIG. 6 is a sectional view of the rest shaft feed mechanism, taken along the line VI—VI of FIG. 5.

DETAILED DESCRIPTION OF PREFERRED EMBODIMENTS

Figure 1:
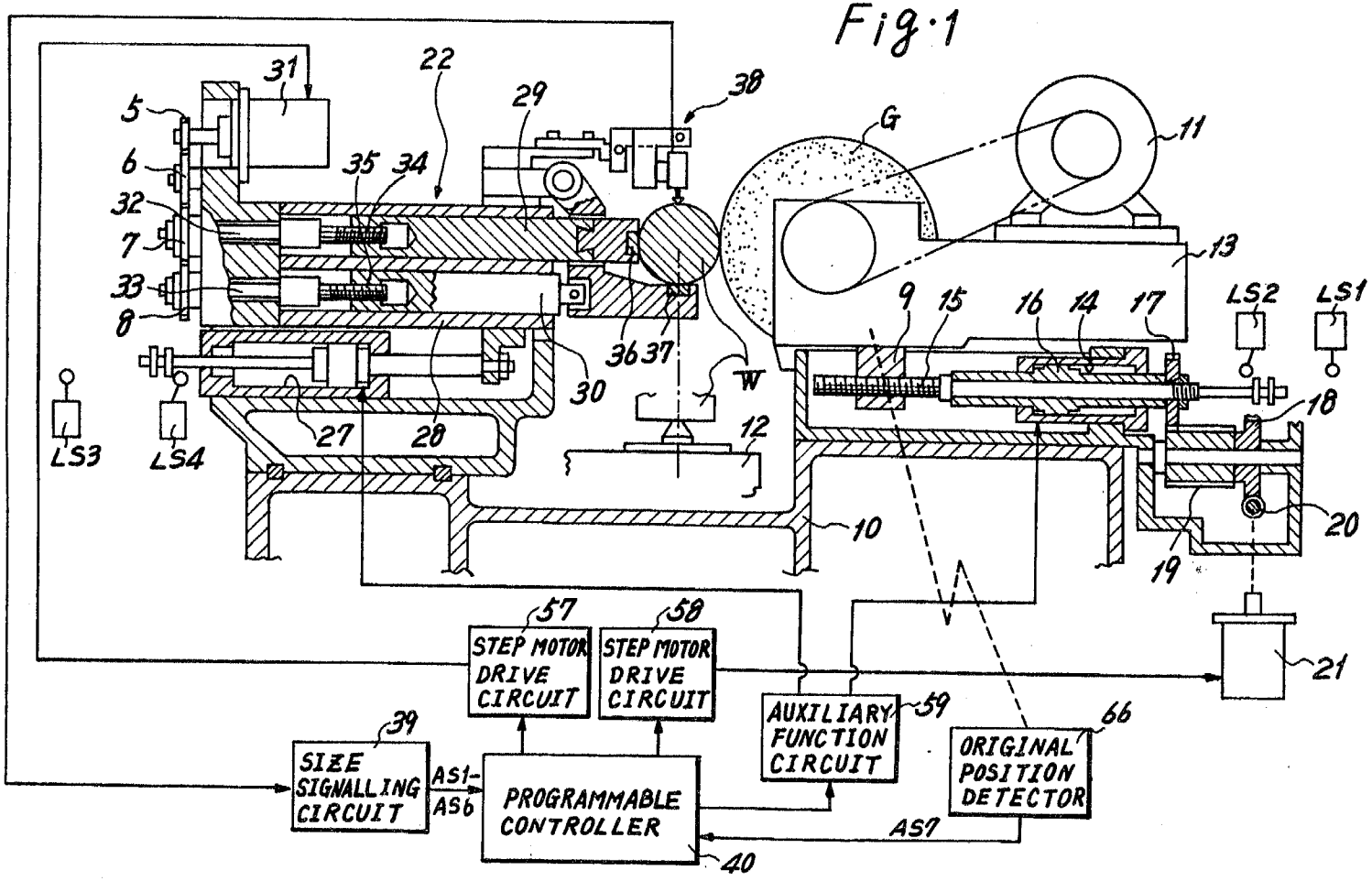
FIG. 1 is a longitudinal sectional view of a grinding machine according to the present invention, particularly illustrating feed mechanisms for a wheel head and a rest apparatus.

Referring now to FIG. 1, there is shown a bed 10, on which is slidably guided a wheel head 13, which rotatably carries a grinding wheel G driven by a motor 11. The wheel head 13 has secured thereto a feed nut 9, which is in thread engagement with a feed screw 15 passing through a rapid feed cylinder 14. The feed screw 15 is permitted to rotate relative to a piston 16 fitted into the rapid feed cylinder 14. A driven gear 17, secured to a rear end of the feed screw 15, is in meshing engagement with a drive gear 19 rotatable integrally with a worm wheel 18, which is driven by a stepping motor 21 through a worm 20. Thus, the wheel head 13 is able to be given a rapid feed by the rapid feed cylinder 14 and a grinding feed by the stepping motor 21 through the feed screw 15.

On the bed 10, there is mounted a rest apparatus 22, which is in position to be opposed to the grinding wheel G through a workpiece W supported by a pair of centers (only one being shown) of a head stock 12 and a foot stock, not shown. The rest apparatus 22 comprises a rest frame or body 28, which is guided for advance and retraction movements and is connected to a piston of a rapid feed cylinder 27. The rest body 28 has slidably inserted therein a pair of non-rotatable rest shafts 29 and 30, whose rear ends are in thread engagement respectively with feed screws 34 and 35 rotatable by a stepping motor 31 for rest shaft feed. A front end of the rest shaft 29 has fixed thereon an upper shoe 36 for supporting the workpiece W from the side opposite to the grinding wheel W, while a front end of the other rest shaft 30 is in abutting engagement with a lower shoe 37 hinged on the rest body 28. On the rest body 28, there is further mounted a measuring device 38 for measuring the outer diameter of the workpiece W. An output from the measuring device 38 is applied to a size signalling circuit 39, which compares the output with a number of preset values in order to issue a first size signal AS1, a second size signal AS2, a third size signal AS3, etc. Reference characters LS1 and LS2 denote limit switches for maintaining retracted and advanced ends of the wheel head 13 in rapid feed, respectively, and LS3 and LS4 denote limit switches for maintaining retracted and advanced ends of the rest body 28 in rapid feed.

Figure 2:
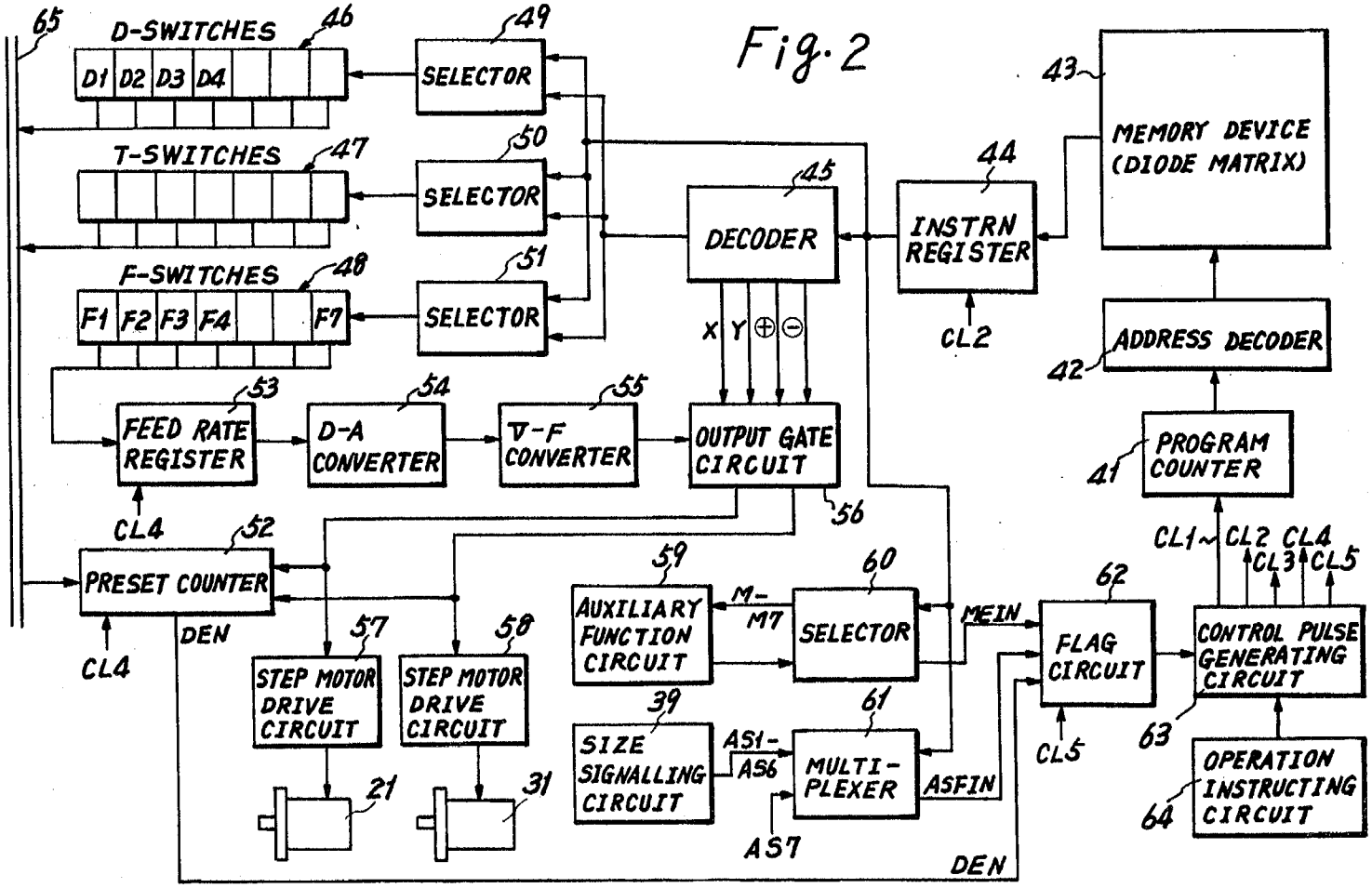
FIG. 2 is a block diagram of the detailed construction of a programmable controller shown in FIG. 1.

Indicated at 40 is a programmable digital feed controller for controlling the operations of the wheel head 13 and the rest apparatus 22, and FIG. 2 illustrates the detailed construction of the controller 40. The controller 40 comprises a program counter 41, an address decoder 42, a memory device 43 for storing a series of program instructions prepared for a number of operation steps, an instruction register 44 for presetting therein any one of the program instructions that is designated by the program counter 41, a decoder 45 for decoding the preset program instruction, a group of digital switches 46 for respectively presetting therein various feed amounts, another group of digital switches 47 for respectively setting therein various periods of time, and a further group of digital switches 48 for respectively setting therein various feed rates. The controller 40 further includes selectors 49–51 each for selecting a specified one switch from the corresponding one of the groups of the digital switches 46–48, and a preset counter 52, which is connected to the groups of the digital switches 46 and 47 through a data bus 65 for receiving, as preset data, data being set in one of the switches that is selected by the selector 49 or 50. A feed rate register 53 is connected to the group of the digital switches 48 for receiving, as preset data, data being set in one of the switches 48 that is selected by the selector 51. Further, a reference numeral 54 denotes a D-A converter for converting a digital command value, indicative of a feed rate being preset in the feed rate register 53, into a corresponding analog signal, 55 denotes a variable frequency pulse generator such as a so-called "V-F converter" for generating a train of pulses at a frequency corresponding to the analog signal, and 56 denotes a gate circuit for sending out output pulses. This gate circuit 56 is responsive to axis designation signals X, Y and direction designation signals (+), (−), applied from the decoder 45, so as to switch gates thereof to output the output pulses. Reference numerals 57 and 58 denote drive circuits, which are connected respectively to the stepping motors 21 and 31 for driving the same upon receipt of the output pulses from the gate circuit 56. The output pulses, sent out from the gate circuit 56, are applied also to the preset counter 52 for subtraction from a preset value being stored therein, and the preset counter 52 is arranged to output a pulse distribution completion signal DEN when the preset value is reduced to zero. A reference numeral 59 denotes an auxiliary function instructing circuit for generating a number of auxiliary function instructions which, for example, command rapid advance and retraction feeds of the wheel head 13 and the rest body 28, 60 denotes a selector for selecting one of the auxiliary function instructions to be output, 61 denotes a multiplexer for selecting one of the size signals AS1, AS2, . . . output from the size signalling circuit 39, and 62 denotes a flag circuit for discriminating among conditions to advance the program step. This flag circuit 62 is set upon receipt of a control pulse CL5, referred to later, and is reset upon receipt of any one of the pulse distribution completion signal DEN, an auxiliary function completion signal MF1N and a designated one (labelled as "ASFIN") of the size signals AS1, AS2 . . . . Indicated at 63 is a control pulse generating circuit, which successively outputs control pulses CL1–CL5 when the flag circuit 62 is reset and discontinues the generation operation after outputting the control pulse CL5. An operation instructing circuit 64 is further provided, which is arranged to apply operation start and stop signals to the control pulse generating circuit 63. The control pulse CL1 is applied to the program counter 41 so as to increment the content stored therein, so that the address switching of the memory device 43 is effected to read out a next program instruction. The control pulse CL2 is applied to the instruction register 44 so as to load a read-out program instruction therein. The control pulse CL3 is aimed at producing a time and therefore, is not in use to control something by itself. The control pulse CL4 is applied to the preset counter 52 and the feed rate register 53 so as to preset therein data being set in those selected from the digital switches 46, 47 and 48, and the control pulse CL5 is applied to the flag circuit 62 so as to set the same.

When the flag circuit 62 is reset upon completion of each program step, the control pulse generating circuit 63 generates the control pulses CL1–CL5, and data settings in a successive program step are thus carried out. The output pulses are immediately applied to either the drive circuit 57 or the drive circuit 58 with the result of executing the feed control of the wheel head 13 or the rest shafts 29 and 30, or the control of an auxiliary function operation is immediately initiated.

It is to be noted herein that feed amounts d1, d2, d3 through which the stepping motor 21 or 31 operates in a number of program steps have been set respectively in switches D1, D2, D3 of the group digital switches 46, and that feed rates f1, f2, f3, f7 have been set respectively in switches F1, F2, F3, F7 of the group digital switches 48. It is also to be noted that the memory device 43, comprising a conventional diode matrix, is provided therein with a plurality of memory areas, which are assigned respectively to a series of program steps constituting one program cycle, and at each of which there have been stored an axis designation instruction for designating one of the stepping motors 21 and 31, a direction designation instruction for designating a rotational direction of the designated stepping motor 21 or 31, and selection instructions for selecting one of the switches D1, D2, . . . and one of the switches F1, F2, . . . . Instead of setting or establishing the feed amounts d1, d2, . . . by the use of the swiches D1, D2, . . . , it is possible to control the feed amounts d1, d2, . . . by utilizing the size signals AS1, AS2, . . . , and in this case, size signal selection instructions AS1, AS2, . . . are programmed instead of selection instructions for the switches D1, D2, . . . . Further, the advance and retraction movement of the wheel head 13 and the rest body 28 by the respective rapid feed cylinders 14 and 28, which act as controlled elements other than the stepping motors 21 and 31, are able to be controlled in conjunction with one another or with any other operation by programming selection instructions for auxiliary functions M1, M2, . . . .

Figure 3:
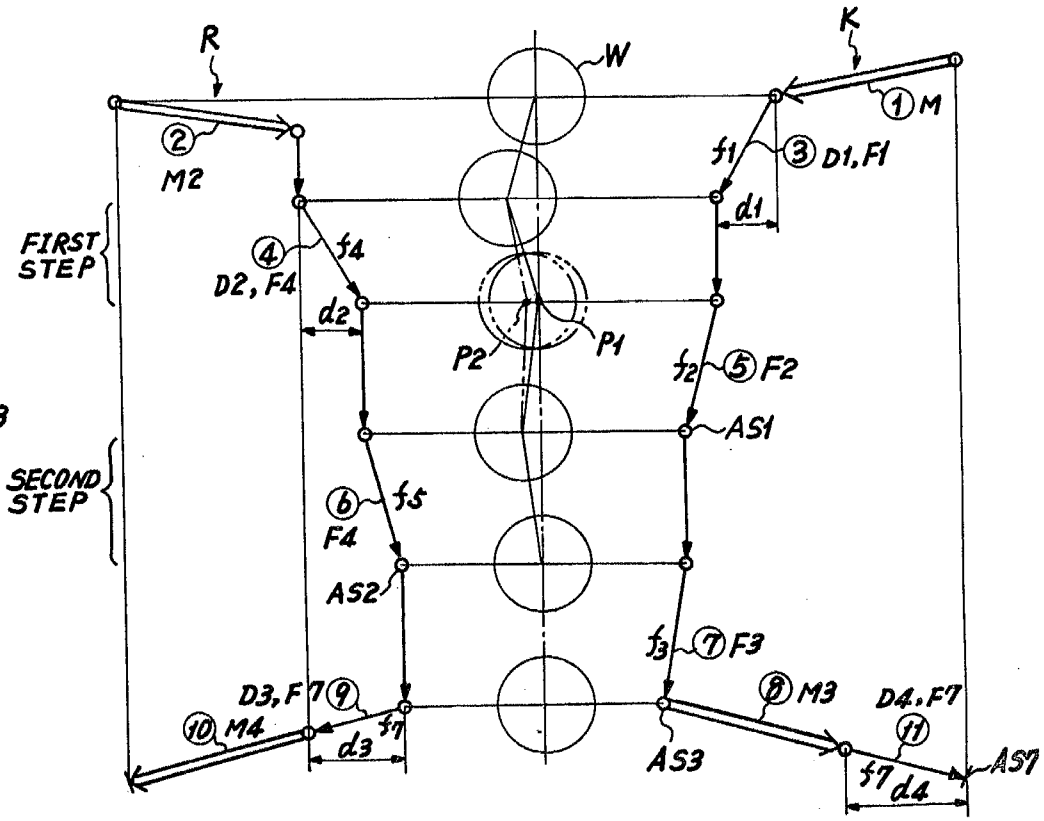
FIG. 3 is a cycle chart illustrating the operations of the wheel head and the rest apparatus.

A grinding cycle and a rest cycle, as indicated respectively at K and R in FIG. 3, are controlled by the programmable controller 40 in conjunction with each other, as will be described hereinafter. After the wheel head 13 is advanced by the rapid feed cylinder 14 to the advanced position, the advance of the rest body 28 is effected by the rapid feed cylinder 27. At the same time as the rapid advance of the rest body 28, the wheel head 13 is fed by the stepping motor 21, a feed amount d1 at a rough grinding feed rate f1 so as to effect a rough grinding. Upon termination of the rough grinding, only the rest shafts 29 and 30 are fed by the stepping motor 31 a feed amount d2 at a feed rate f4, and this causes the shoes 36, 37 to be pressed against the workpiece W so as to remove a flexing caused by grinding resistance from the workpiece W, whose axis is thus aligned with a point P1. Subsequently, the wheel head 13 is advanced at a fine grinding feed rate f2 until the issuance of the first size signal AS1. The issuance of the first size signal AS1 causes the rest shafts 29, 30 to be advanced until the issuance of the second size signal AS2. The issuance of the second size signal AS2 causes the wheel head 13 to be re-advanced at a fine grinding feed rate f3 until the issuance of the third size signal AS3. With the issuance of the third size signal AS3, the rest shafts 29 and 30 are retracted by a set amount d3 at a rapid feed rate f7, and the wheel head 13 is also retracted by the rapid feed cylinder 14. After the retraction of the rest shafts 29 and 30, the rest body 28 is retracted by the rapid feed cylinder 27, and the wheel head 13 is retracted by the stepping motor 21 at a rapid feed rate f7 until it actuates a conventional position detector 66 shown in FIG. 1 so as to cause the same to output original position confirmation signal AS7, whereby one cycle operation is completed.

The retraction amount d3 of the rest shafts 29, 30 has been set to be a feed amount through which, where no wear of the shoes 36, 37 is effected, each of the shoes 36, 37 is advanced from the start point until the issuance of the second size signal AS2. It is therefore understood that, if no wear of the shoes 36, 37 is effected during the foregoing one cycle, the pressing surface of each of the shoes is returned to the feed start point, but that, if some wear is effected on the shoes, the pressing surface of each of the shoes is returned to a position that is advanced from the feed start point by the wear amount. This new return position is chosen as the feed start point in a successive cycle, so that, when the shoes are advanced by a predetermined amount being set as the feed amount d2, the pressing surface of each of the shoes reaches the same position as does the pressing surface where no wear is effected. This results in the compensation for wear of the shoes, and any flexing of the workpiece W caused by grinding resistance can be removed at a stage preceding the fine grinding step, thus improving the roundness of the workpiece W. That is, the deterioration of roundness caused by wear of the shoes can be obviated in the foregoing manner.

In the above-described embodiment, the retraction amount d3 is a predetermined amount that is set in the digital switch D3 of the group switches 46 and the compensation for wear of the shoes is carried out by controlling the stepping motor 31 in accordance with the set amount. However, the retraction amount may otherwise be set to be constant by providing detecting means as illustrated in FIG. 4 and by controlling the rotation for retraction of the stepping motor 31 in dependence upon the detecting means.

Figure 4:
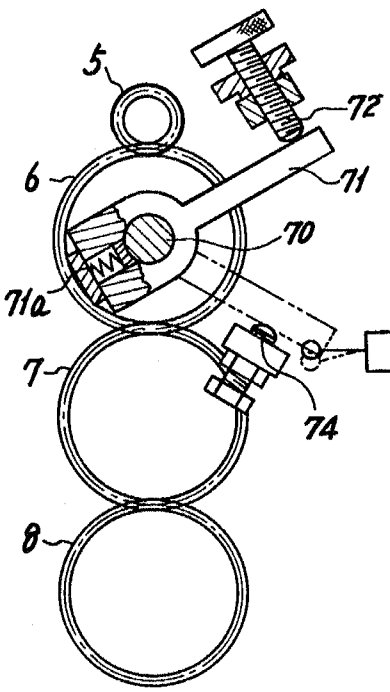
FIG. 4 is a fragmental enlarged view of a rest shaft feed mechanism in another embodiment.

Referring now to FIG. 4, a pivotable slide lever 71 is in friction engagement, by the agency of a spring 71*a*, with a gear shaft 70 carrying a gear 6 both of which constitute a feed gear mechanism for the rest shafts 29, 30. A stop 72, abuttable with the slide lever 71, is disposed in position to restrict the rotational advanced end of the slide lever 71, and a detector 73 such as a limit switch is disposed being angularly distanced from the stop 72 by a distance corresponding to the movable stroke of the shoes. The detector 73 is able to be actuated by the slide lever 71, and in order to stop the retraction feed of the stepping motor 31 based on an output signal from the detector 73, the output signal is applied as one of the size signals to the programmable controller 40, namely to the multiplexer 61. After the shoes which have worn out beyond a tolerable amount are exchanged with fresh ones, it is necessary to adjust the retracted end of a pressing surface of each of the fresh shoes. To this end, in the vicinity of the detector 73, there is provided a second stop 74, which acts to abut with and rotate the slide lever 71 relative to the shaft 70 when, for that purpose, the rotational retraction of the gear shaft 70 is further effected from the retracted end where the slide lever 71 actuates the detector 73, by an angular distance corresponding to the tolerable amount.

The slide lever 71 as constructed above is rotated integrally with the shaft 70 and synchronously with the advance feed of the rest shafts 29, 30 when, as indicated by the cycle R in FIG. 3, such advance is effected by the stepping motor 31. The position of the stop 72 has been so adjusted that, if no wear appears on the shoes, the slide lever 71 is brought into abutting engagement with the stop 72 when each of the shoes is advanced to a position where the second size signal is generated. In this connection, if some wear appears on the shoes, the position of the lever 71 when the second size signal is generated is retracted relative to the shaft 70 by an angular distance corresponding to the wear amount. When the shoes are retracted in this situation, the slide lever 71 is caused to actuate the detector 73 at a position advanced by the angular distance corresponding to the wear amount of the shoes from the position where, if no wear appears on the shoes, the slide lever 71 would actuate the detector 73, so that the pressing surface of each of the shoes is stopped at a position which advances the wear amount from the advance start position thereof in the same cycle. The stop position is chosen as an advance start point in a successive cycle, and consequently, the compensation for wear of the shoes can be achieved like that in the first mentioned embodiment.

FIGS. 5 and 6 illustrate a modification of the embodiment shown in FIG. 4. In this modification, there are provided an operating rod 78 movable back and forth through a rack 77 and synchronously with the stepping motor 31 for the rest shafts 29 and 30, a slide dog 79 carried on one end of the operating rod 78 through a friction engagement therewith, a stop 80 abuttable with the slide dog 79 advancing, and a limit switch 82 provided in position to be actuated by the slide dog 79 retracting. This and the foregoing embodiments are different from each other in that the pivot movement of the slide lever 71 is altered to the straight movement of the operating rod 78, but they are almost the same in other respects of construction. It is noted herein that this embodiment shown in FIGS. 5 and 6 is designed to enable the stepping motor 31 to synchronously operate the two pairs of rest shafts 29, 30. Dogs 83 and 84 on the other end of the operating rod 78 are provided for respectively actuating limit switches LS5 and LS6. The limit switch LS5 is in position to maintain the original position of each of the shoes, and after the exchange of the worn-out shoes, the operating rod 78 is retracted until the actuation of the limit switch LS5. The limit switch LS6 is for detecting the attainment of the shoes to the limit of use and, when actuated, informs an operator of the necessity of the exchange of the shoes.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A grinding machine comprising:

a base;

workpiece support means provided on said base for rotatably carrying a workpiece;

a wheel head slidably mounted on said base and adapted to rotatably carry a grinding wheel;

wheel feed means for feeding said wheel head toward and away from said workpiece;

measuring means for measuring said workpiece so as to generate first and second size signals respectively when said workpiece is ground to first and second predetermined sizes;

a rest frame provided on said base;

rest shoe means carried on said rest frame for supporting said workpiece against grinding resistance;

shoe feed means for feeding said rest shoe means toward and away from said workpiece;

advance feed control means for controlling said shoe feed means to advance said rest shoe means toward said workpiece until said first size signal is generated from said measuring means and for controlling said wheel feed means to advance said wheel head toward said workpiece until said second size signal is generated from said measuring means;

a movable member drivingly connected with said shoe feed means for movement synchronous with the operation of said rest shoe means;

a slide member carried on said movable member through friction engagement therewith;

stop means abuttable with said slide member for restricting movement thereof at a first predetermined position;

detector means actuatable by said slide member when said rest shoe means is retracted to a retracted end position, for generating a stop signal to discontinue the operation of said shoe feed means, said retracted end position being spaced a predetermined retraction amount from an advanced end position of said rest shoe means which is adjusted in dependence upon said first size signal; and retraction feed control means responsive to said second size signal for controlling said wheel feed means and said shoe feed means to respectively retract said wheel head and said rest shoe means away from said workpiece and also responsive to said stop signal for controlling said shoe feed means to position said rest shoe means at said retracted end position.

2. A grinding machine as set forth in claim 1, wherein:

said retraction feed control means is operable in each grinding cycle for controlling said shoe feed means to retract said rest shoe means to said retracted end position which is spaced said predetermined retraction amount from said advanced end position; and said advance feed control means is operable in a successive grinding cycle following said each grinding cycle for controlling said shoe feed means to advance said rest shoe means from said retracted end position to a new advanced end position which is controlled in dependence upon said first size signal generated from said measuring device in said successive grinding cycle.

3. A grinding machine as set forth in claim 2, wherein:

said movable member is a shaft carried on said rest frame for rotation synchronous with the operation of said shoe feed means;

said slide member is a pivotable slide lever carried on said shaft through friction engagement therewith; and said stop means is disposed in position to restrict advance pivot movement thereof at said first predetermined position.

4. A grinding machine as set forth in claim 2, wherein:

said movable member is an operating rod guided on said rest frame for straight movement synchronous with the operation of said shoe feed means;

said slide member is a slide dog carried on said rod through friction engagement therewith; and said stop means is disposed in position to restrict advance straight movement thereof at said first predetermined position.

5. A grinding machine as set forth in claim 1, wherein said measuring means is adapted to generate a third size signal when said workpiece is ground to a third predetermined size larger than said first and second predetermined sizes, and wherein said advance feed control means comprises:

first advance control means for controlling said wheel feed means to advance said wheel head a first predetermined amount at a first feed rate;

second advance control means for controlling said shoe feed means to advance said rest shoe means a second predetermined amount from said retracted end position at a second feed rate after the operation of said first advance control means is completed;

third advance control means for controlling said wheel feed means to readvance said wheel head at a third feed rate until said third size signal is generated from said measuring means after the operation of said second advance control means is completed;

fourth advance control means responsive to said third size signal for controlling said shoe feed means to readvance said rest shoe means at a fourth feed rate until said first size signal is generated from said measuring means; and fifth advance control means responsive to said first size signal for controlling said wheel feed means to readvance said wheel head at a fifth feed rate until said second size signal is generated from said measuring means.

6. A grinding machine as set forth in claim 5, wherein said rest shoe means comprises:

a pair of rest shafts slidably received in said rest frame and drivingly connected to said shoe feed means for being moved toward and away from said workpiece;

an upper shoe secured to a front end of one of said rest shafts for supporting said workpiece from a side which is opposite to said grinding wheel through said workpiece; and a lower shoe pivotably carried on said rest frame and engaged with a front end of the other of said rest shafts for supporting said workpiece from a side which is under said workpiece.

* * * * *